United States Patent [19]

Feldkämper

[11] 4,432,686

[45] Feb. 21, 1984

[54] APPARATUS FOR PLACING PACKETS OF TUBE SECTIONS IN THE STACKING MAGAZINE OF A ROTARY APPLICATOR

[75] Inventor: Richard Feldkämper, Lengerich, Fed. Rep. of Germany

[73] Assignee: Windmoller & Holscher, Lengerich, Fed. Rep. of Germany

[21] Appl. No.: 328,526

[22] Filed: Dec. 8, 1981

[30] Foreign Application Priority Data

Dec. 9, 1980 [DE] Fed. Rep. of Germany ..... 3046280

[51] Int. Cl.[3] ..... B65H 57/06; B65H 29/36

[52] U.S. Cl. ..... 414/77; 193/2 D; 198/535; 271/95; 271/191; 414/82

[58] Field of Search ..... 414/52, 76, 77, 80, 414/82, 84; 271/95, 165, 166, 191; 193/2 D; 198/535, 592, 603

[56] References Cited

U.S. PATENT DOCUMENTS

| | | | |
|---|---|---|---|
| 499,460 | 6/1893 | Hooper | 198/592 X |
| 2,390,895 | 12/1945 | Pabst | 193/2 D X |
| 3,844,402 | 10/1974 | Hayashi | 198/603 X |

FOREIGN PATENT DOCUMENTS

| | | | |
|---|---|---|---|
| 2003087 | 7/1971 | Fed. Rep. of Germany | 271/95 |
| 2721440 | 11/1978 | Fed. Rep. of Germany | 414/84 |
| 1321120 | 2/1963 | France | 414/77 |
| 1529943 | 5/1968 | France | 414/84 |

*Primary Examiner*—Leslie J. Paperner

*Attorney, Agent, or Firm*—Fleit, Jacobson, Cohn & Price

[57] ABSTRACT

In an apparatus for placing packets of tube sections in the stacking magazine of a rotary applicator, a pivotable arm is divided between the stacking magazine and conveyor belt for supplying the tube section packets. The arm carries a longitudinally displaceable supporting frame having rollers at its ends for an endless conveyor belt. The arm is pivotable between an upper packet-receiving station and a lower packet-discharging station and is provided with an abutment for retaining the packets on the supporting frame. A braking system engages the upper run of said belt between the abutment and the rear roller and releases same to receive the packets.

17 Claims, 7 Drawing Figures

1
2
4
4.2
5
4.1
6
7
3
1
10
20.2
8
20.1
21
9
23
16
17
15
18
20
14
1
43
30.1
30
22
11
10
31
12
19
103

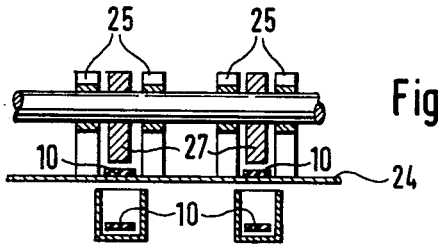
Fig. 4
Fig. 5
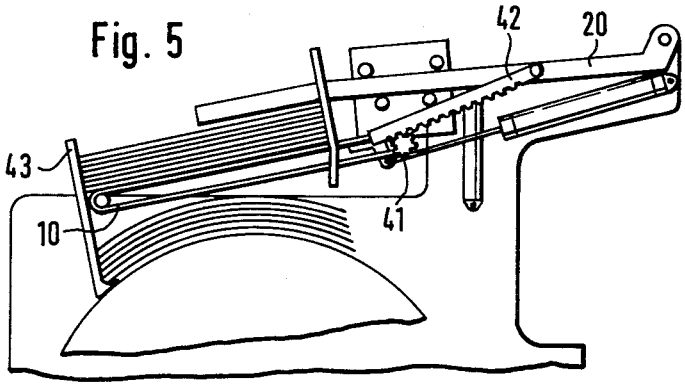
Fig. 6
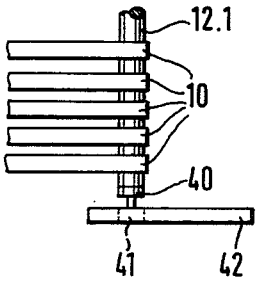

APPARATUS FOR PLACING PACKETS OF TUBE SECTIONS IN THE STACKING MAGAZINE OF A ROTARY APPLICATOR

The invention relates to an apparatus for placing packets of tube sections in the stacking magazine of a rotary applicator equipped with suction rollers.

In an apparatus of this kind known from DE-OS No. 24 54 314, the tube section packets are placed in the stacking magazine by hand or can also be replenished automatically.

It is the problem of the invention to improve the known apparatus for automatically placing tube section packets in the stacking magazine of rotary applicators so that slipping of the packets is avoided during their insertion.

According to the invention, this problem is solved in that, between the stacking magazine and the conveyor means supplying the tube section packets, there is a pivotably mounted arm on which a supporting frame is longitudinally displaceable, the frame being provided at the ends with direction-changing rollers over which endless belts run and being pivotable by a pivot drive between its upper, obliquely rising position in which it receives the tube section packets and its lowered position in which it discharges them again, and that the arm is provided with an abutment securing the tube section packets on the supporting frame and with braking means which engage the upper run of the belts between the abutment and the rear direction-changing rollers and which comprise means for releasing same to receive the tube section packets in the raised position. Since in the raised position the belts running over the freely rotatable direction-changing rollers in the supporting frames can turn freely without braking and the supporting frame has a slightly oblique position, tube section packets presented to the free end of the supporting frame are moved gently downwardly under gravity until they strike the abutment. During lowering of the supporting frame into the stacking magazine, the brake is engaged so that the belts are blocked and the packet of tube sections thereon cannot slip. After lowering of the supporting frame into the stacking magazine, the supporting frame is retracted by a drive so that the belts located on the arm remain stationary in relation to the packet and roll along therebeneath in a manner such that the packet is deposited without slip on the last packet disposed in the stacking magazine. For the purpose of transferring the next tube section packet, the supporting frame is then projected again and lifted to its upper position.

As in the case of the apparatus of DE-OS No. 24 54 314, the apparatus of the invention can of course be desirably provided with pressure means which act on the tube sections, are substantially flat in the region of the stack and are lowerable as the stack height is reduced. On reaching a certain spacing from the suction rollers of the rotary applicator, actuating means move the pressure means out substantially in the plane of the tube section on which they are pressing, take them above the level of the last positioned tube packet and lower them thereon again.

FIGS. 13 to 15 of FR-PS No. 15 29 943 disclose an apparatus for placing tube section packets in the stacking magazine of a rotary applicator, comprising a pivotable and reciprocatable roller track. However, it has the disadvantage that the tube section packets are not located on the roller track so that they can move in an uncontrollable manner during lowering.

The depositing of stacks lying on belts by rolling the belts over a direction-changing roller retracted beneath the stack is known per se from DE-OS No. 23 02 955.

Advantageous embodiments of the invention have been described in the subsidiary claims.

One example of the invention will now be described in more detail with reference to the drawing, wherein:

FIG. 4 is a section through the means for clamping the belts;

FIG. 5 is a side elevation of the supporting frame of a second embodiment of the apparatus, the supporting frame having been lowered to the region of the stacking magazine;

FIG. 6 is a plan view of the belts of the FIG. 5 supporting frame running over the rear direction-changing roller.

Figure 1:
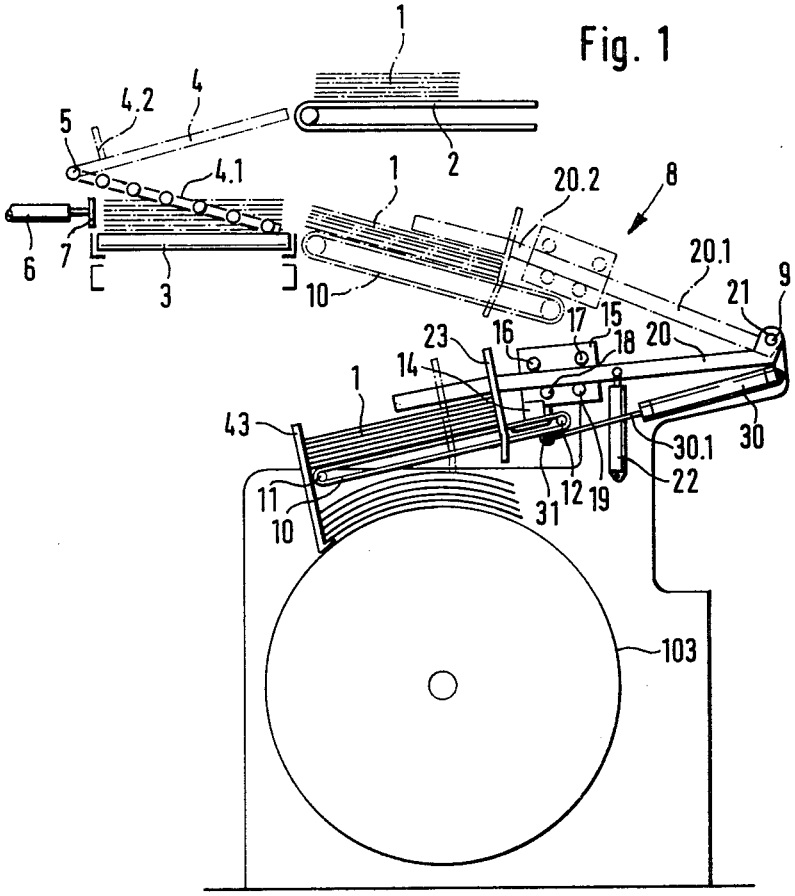
FIG. 1 is a diagrammatic side elevation of the apparatus for placing tube section packets into the stacking magazine of a rotary applicator.

In the apparatus diagrammatically illustrated in FIG. 1, the tube section packets 1 are supplied by the storage conveyor belt 2 in a transverse position or on a roller track 3 in the longitudinal direction.

When the supply is by way of the storage conveyor belt 2, a pivotable roller track 4 is provided which has a pivot shaft 5 in front of the storage conveyor belt 2 that is disposed somewhat lower than the discharge end of the storage conveyor belt 2. For the purpose of receiving a tube section packet 1, the roller track 4 is lifted to its raised position as shown in chain-dotted lines. After transfer of a tube section packet 1, the roller track 4 is lowered to its full-line position 4.1 so that the packet 1 can run off under gravity.

If the roller track 3 is provided instead of the storage conveyor belt 2, the tube section packets 1 are fed in the longitudinal direction. A push member 7 behind the roller track 3 is actuated by a piston-cylinder unit 6 for pushing off the packets 1.

The packet applicator 8 primarily consists of a reciprocatable belt guide 10 which is pivotable about a shaft 9 and of which the belts run over rollers 11, 12. The latter are freely rotatably mounted in tubes 13 of rectangular cross-section. The tubes 13 are interconnected by a rectangular tube 14 extending transversely thereto. The tube 14 is secured to a carriage 15 having four rollers 16 to 19 which are reciprocatable on a guide rod 20. The guide rod 20 has a bore 21 for a fixed shaft 9. The guide rod 20 can be pivoted to the position 20.1 by means of a pressure cylinder 22 pivoted to the frame of the machine. The free end of the guide rod 20 is flanged slightly downwardly at the position 20.2 An abutment 23 can be displaced on and clamped to the flanged part of the guide rod 20 so that the packet inserter 8 is adjustable to the particular size of the tube sections. On a plate 24 fixed to the guide rod 20 there are guide blocks 25 for a shaft 26 on which brake levers 27 can be pressed by means of a spring 28 against the upper runs of the belts 10. When the guide rod 20 has been swung upwardly to the position 20.1, the free ends of the brake levers 27 strike a fixed abutment so that the brake levers 27 are pivoted and the braking effect on the belts 10 is released.

The tube section packets 1 supplied by the pivotable roller track 4 or discharged from the roller track 3 by the push member 7 can move on the freely running belts 10 up to the abutment 23. When the guide rod 20 is lowered, the brake levers 27 become free from the abutment 29 and the belts 10 are braked. In the lowered position, the rectangular tubes 13 are displaced to the right, for example by a pressure cylinder 30 of which the piston rod is hinged to the tubes 13 by a lug 31. The rollers 11, 12 are thereby retracted towards the right-hand side whilst the upper runs of the belts 10 remain stationary so that, upon lowering of the stack 1 onto a stack 1.1 disposed on a rotary applicator 103, there can be no displacement of the individual tube sections of the packet 1.

In a manner not shown in the drawing, the roller track 4 is displaceable normal to the plane of the drawing so that the packets 1 supplied on the storage conveyor belt 2 in an offset relationship to the belt guide 10 as viewed in plan can be transferred to the belt guide 10 in an accurately aligned form by moving the roller track 4 and fed centrally to the rotary applicator 103. After the transfer of one tube section packet 1, the roller track 4 is laterally returned to its starting position.

In the FIGS. 5 and 6 embodiment, the endless belts 10 do not run over freely rotatably mounted rollers or cylinders but over a shaft 12.1 connected to a gear 41 by a releasable clutch. The gear 41 is in mesh with a rack 42 having its end hinged to the arm 20.

Figure 2:
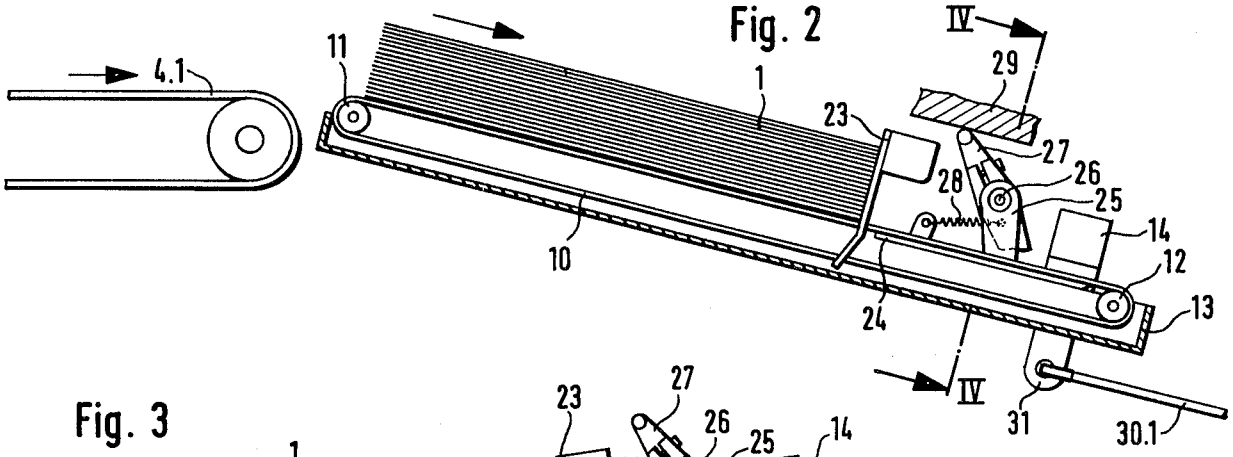
FIG. 2 shows part of the FIG. 1 apparatus with the supporting frame in a lifted position.
Figure 3:
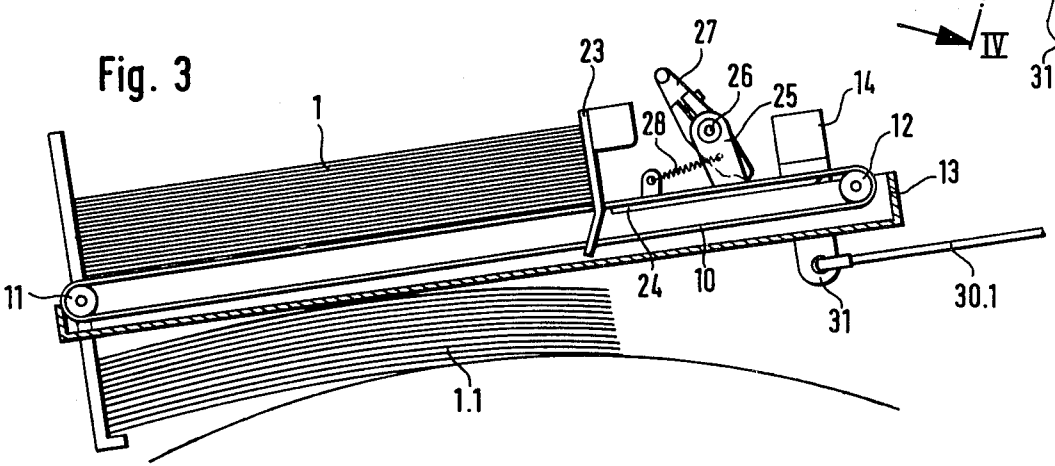
FIG. 3 shows part of FIG. 1 apparatus with the supporting frame in a lowered position.

The clutch 40 can be engaged and disengaged in known manner with the aid of control means. In the raised FIG. 2 position of the arm 20, the clutch is disengaged so that the packet to be received can run freely under gravity onto the receptacle formed by the belts 10. Before or during pivoting of the arm 20, the gear 41 is coupled to the shaft 12.1 by actuating the clutch 40, so that the belts 10 are blocked and the packet cannot run off when the arm 20 is swung into the stacking magazine in the manner shown in FIG. 5. If, now, the piston-cylinder unit 30 is actuated, the belts 10 are rolled beneath the packet but there is no relative motion between the belts 10 and the packet 1.

It may be desirable for the gear 41 to have an effective diameter somewhat smaller than the shaft 12.1 so that, during depositing of the packet, the latter is displaced forwardly and thereby held in contact with the abutment 43.

As already evident from FIG. 1, the supporting frame 13, 14 and the arm include a small angle so that, during transfer of the packet, the supporting frame will not assume too large an angle which would result in excessively rapid insertion of the packets. Further, this angling is desirable so that the supporting frame or the belts can be well adapted to and placed against the stack already located on the rotary applicator 103.

Figure 7:
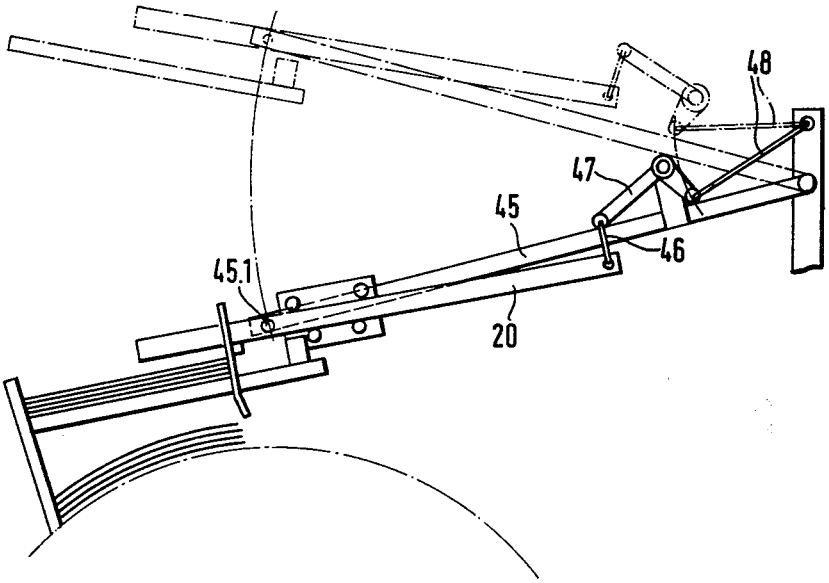
FIG. 7 is a side elevation of a third embodiment of the apparatus in which the arm carrying the pivoted frame is pivoted to a pivot lever.

An excessive inclination of the supporting frame in the receiving and discharge position can be avoided by an appropriately long length for the arm. However, to enable one to dispense with such large constructional lengths, the FIG. 7 embodiment provides for the arm 20 to be pivoted at the point 45.1 to a pivot lever 45 which is pivotably mounted in the machine frame. The rear end of the arm 20 is hinged to a lug 46 which is pivoted to a two-armed lever 47 mounted on the pivot lever 45. The other end of the two-armed lever 47 is hinged to a rod or lug 48 of which the free end is pivoted to the machine frame. The lengths of the levers and links are selected so that, in the raised position of the supporting frame shown in chaindotted lines, the supporting frame is less inclined than is the pivot lever 45.

The piston-cylinder unit 22 may be hinged to the arm 20 or to the pivot lever 45. Further, the lug or rod 48 could also be formed by a piston-cylinder unit. In that case it would be possible in the lowered condition of the supporting frame to adapt the packet to be deposited even more closely to the remaining stack in the magazine.

The roller track 4 pivotable about the shaft 5 and shown in FIG. 1 may additionally be provided in the region of the shaft 5 with an abutment 4.2 which upstands therefrom at right-angles and extends transversely thereto. When the tube section packets 1 are transferred from the conveyor 2 to the roller track 4, the leading edges of the tube section packets 1 are aligned against the abutment 4.2 when striking same. When the tube section packet pivoted together with the roller track 4 is subsequently discharged to the belt guide 10, its leading edge is aligned in front of the abutment 23.

Instead of the abutment 4.2, there could also be a push member which is acutated by a piston-cylinder unit of the kind illustrated in FIG. 1 in connection with the roller track 3.

There may also be a pivotable conveyor belt to replace the pivotable roller track 4.

I claim:

1. Apparatus for placing packets of tube sections in the stacking magazine of a rotary applicator equipped with suction rollers, characterised in that, between the stacking magazine and the conveyor means supplying the tube section packets, there is a pivotably mounted arm on which a supporting frame is longitudinally displaceable, the frame being provided at the ends with direction-changing rollers over which endless belts run and being pivotable by a pivot drive between its upper, obliquely rising position in which it receives the tube section packets and its lowered position in which it discharges them again, and that the arm is provided with an abutment securing the tube section packets on the supporting frame and with braking means which engage the upper run of the belts between the abutment and the rear direction-changing roller and which comprise means for releasing same to receive the tube section packets.

2. Apparatus according to claim 1, characterised in that the braking apparatus comprises a plate which is disposed below the upper run of the belts and on which, at flanges projecting beyond the belts there are spring-influenced brake levers which push the belts against the plate.

3. Apparatus according to claim 2, characterised in that the brake levers have two arms and co-operate with a fixed abutment to release the belts in the raised position of the supporting frame.

4. Apparatus according to claim 1, characterised in that the arm is provided with a piston-cylinder unit for displacing the supporting frame.

5. Apparatus according to claim 1, characterised in that the supporting frame is secured to a carriage running on the arm by way of rollers.

6. Apparatus according to claim 1, characterised in that for the purpose of transferring the tube section packets from supply conveyor means to the belts there is a pivotable roller track which is displaceable in the direction of its pivot shaft.

7. Apparatus according to claim 1, characterised in that, in its raised position, the pivot frame adjoins conveyor means with the belts the conveyor means being provided with a push member for pushing the tube section packets onto the belts.

8. Apparatus according to claim 1, characterised in that the arm is pivoted to a pivot lever pivoted to the machine frame and a linkage is provided which consists of rods and levers and, in the raised position of the pivot lever swings the arm downwardly relatively thereto and, in the lowered position, is adapted to the position of the stack located in the magazine.

9. Apparatus, particularly according to claim 1, characterised in that pivotably mounted conveyor means are provided for transferring the stacks from the supply conveyor means to the supporting frames provided with the belts.

10. Apparatus according to claim 9, characterised in that the conveyor means are provided in the region of the pivot shaft with an abutment which upstands perpendicular thereon and extends transversely thereto.

11. Apparatus according to claim 9 characterised in that the conveyor means comprise a roller track.

12. Apparatus according to claim 9 characterised in that the conveyor means comprise a belt conveyor equipped with a drive.

13. Apparatus for placing packets of tube sections in the stacking magazine of a rotary applicator equipped with suction rollers, said apparatus comprising:

an arm pivotably mounted to the rotary applicator; a supporting frame longitudinally displaceable on said arm;

a plurality of endless belts;

said frame being provided with a first and a second direction-changing roller over which said endless belts run;

a pivot drive for moving said frame between an upper, obliquely rising position in which said frame receives the packets of tube sections and a lowered position in which said frame discharges the tube section packets; and braking means for engaging said belts at said lowered position of said frame and during the descent of said frame from said upper position until reaching said lowered position.

14. Apparatus according to claim 13, wherein said arm is provided with a piston-cylinder unit for displacing said supporting frame.

15. Apparatus according to claim 14, characterised in that, in said raised position, said belts of said frame are adjacent to a conveyor means, said conveyor means being provided with a push member for pushing the packets of tube sections onto said belts.

16. Apparatus according to claim 13, wherein said braking means comprise a clutch means connecting the second direction-changing roller to a gear, and said gear is in mesh with a rack connected to said arm.

17. Apparatus according to claim 16, wherein said rack is hinged to said arm.

* * * * *